United States Patent [19]

Yoneyama

[11] Patent Number: 4,582,321

[45] Date of Patent: Apr. 15, 1986

[54] GOLF CLUB HEAD

[75] Inventor: Minoru Yoneyama, Niigata, Japan

[73] Assignee: Yonex Kabushiki Kaisha, Niigata, Japan

[21] Appl. No.: 725,652

[22] Filed: Apr. 22, 1985

Related U.S. Application Data

[62] Division of Ser. No. 524,039, Aug. 17, 1983, Pat. No. 4,534,558.

[30] Foreign Application Priority Data

| | | | |
|---|---|---|---|
| Dec. 28, 1982 | [JP] | Japan | 57-196213[U] |
| Dec. 28, 1982 | [JP] | Japan | 57-196214[U] |
| Jun. 3, 1983 | [JP] | Japan | 58-83929[U] |
| Jun. 3, 1983 | [JP] | Japan | 58-83930[U] |
| Jun. 7, 1983 | [JP] | Japan | 58-85790[U] |

[51] Int. Cl.[4] ..... A63B 53/04

[52] U.S. Cl. ..... 273/78; 273/173

[58] Field of Search ..... 273/78, 167 H, 167 J, 273/169, 171, 172, 173, 174, 167 F, 167 K, DIG. 8, DIG. 23

[56] References Cited

U.S. PATENT DOCUMENTS

| | | | |
|---|---|---|---|
| 1,222,770 | 4/1917 | Kaye | 273/78 |
| 1,602,567 | 10/1926 | Colwell | 273/78 |
| 2,447,967 | 8/1948 | Stone | 273/78 |
| 3,218,072 | 11/1965 | Burr | 273/78 |
| 4,534,558 | 8/1985 | Yoneyama | 273/78 |

*Primary Examiner*—George J. Marlo

*Attorney, Agent, or Firm*—Wenderoth, Lind & Ponack

[57] ABSTRACT

A golf club head includes a core formed integrally with a sole of the head and extending upwardly therefrom in a triangular cross section. The core is formed of metal, such as soft iron or stainless steel. A covering over the entire core and tubular shaft receiving hosel, made integral with the covering, are made from a fiber reinforced resin consisting principally of carbon fiber to form a clubface and hosel of the same material. The lower marginal edge of the clubface is formed flush with the sole.

7 Claims, 20 Drawing Figures

GOLF CLUB HEAD

This is a division of application Ser. No. 524,039, filed Aug. 17, 1983.

BACKGROUND OF THE INVENTION

The present invention relates to the head structure of golf clubs and, more particularly, to an improvement in the head structure of iron clubs.

In general, iron clubs are intended primarily for second, third and bunker shots rather than tee shots, and they are used often for hitting shots from the bare ground, a sandy place and so on as well, as well as from turf. Accordingly, conventional iron clubs are designed so that the club head is made in one body from a metallic material such as soft iron, stainless steel or the like in order to prevent the club head, and in particular its sole, from being readily damaged by a pebble or sand when hitting a ball.

In the design of such a club head, it is regarded as preferable in terms of function to add weight to the toe, the heel and the sole of the club head and to lessen the weight of the hitting region of the clubface. From this point of view, the hitting region is usually formed thin, but this results in the defect of decreased distance of a ball hit by such a club. Further, the hitting region of the clubface is made of a hard metal, and hence its repulsive force is small. Accordingly, the use of hard metal is not always preferable from the viewpoints of the direction and distance of the ball.

SUMMARY OF THE INVENTION

It is therefore an object of the present invention to provide the head structure of iron clubs, the hitting region of which is made of a material of relatively large repulsive force for greater distance and more stable direction of the ball.

Another object of the present invention is to provide a golf club head which can improve the "feel" of shots.

A further object of the present invention is the provision of a golf club head which is so tough as to prevent damage thereto when it is used to hit a ball on bare ground or in a bunker.

According to the present invention, a golf club head is provided in which a core formed integrally with a sole of the head and extending upwardly therefrom in a triangular cross section is formed of metal, such as soft iron or stainless steel. At least the front of the core is covered with fiber reinforced resin consisting principally of carbon fiber to form a clubface, and the lower marginal edge of the clubface is formed flush with the core.

Preferably, the core is covered on both sides thereof with the fiber reinforced resin which is then substantially in the form of a letter V.

More preferably, the core may have a through hole extending from the front to the back of the core, and the through hole is filled with the fiber reinforced resin.

A hosel for receiving a shaft may be formed of metal integrally with the core and may be covered with the fiber reinforced resin. Alternatively, a hosel may be entirely formed of the fiber reinforced resin.

Further objects and features of the present invention will become apparent from the detailed description of preferred embodiments thereof when taken in conjunction with the accompanying drawings, in which:

DETAILED DESCRIPTION OF THE INVENTION

Figure 2:
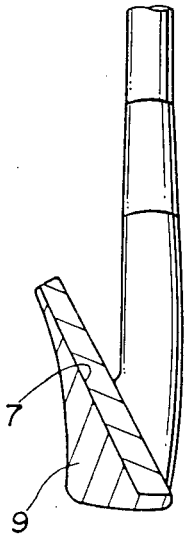
FIG. 2 is a sectional view taken on the line II—II in FIG. 1.
Figure 1:
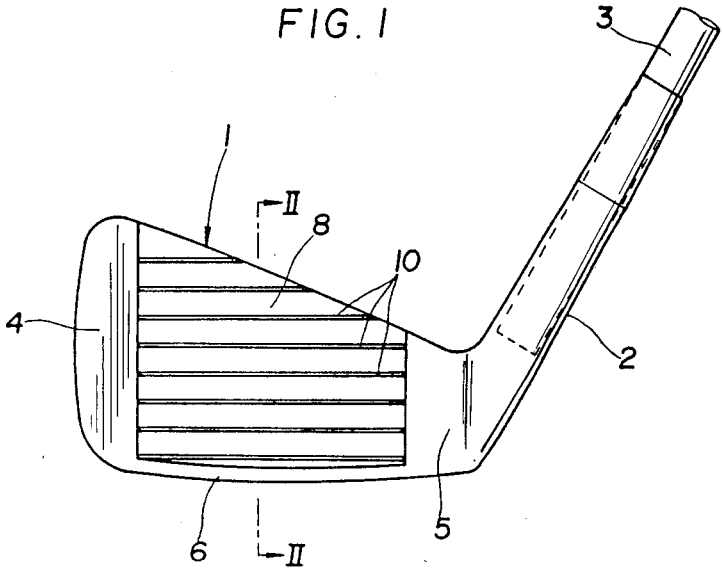
FIG. 1 is a front view illustrating a first embodiment of the golf club head of the present invention.

The head structure of the first embodiment shown in FIGS. 1 and 2 has a frontal contour similar to those of conventional iron club heads and a head body 1 and a hosel 2 made of soft iron, stainless steel, brass or like material. The hosel 2 is a tubular socket for receiving a shaft 3. The central portion of the front of the head 1, defined by its toe 4, heel 5 and sole 6, is recessed as indicated by reference numeral 7 and a faceplate 8 formed of synthetic resin reinforced principally by carbon fiber is fitted into the recess 7 and stuck firmly to the head 1 as a unitary structure therewith. The faceplate 8 is backed by a core 9 which has a generally triangular cross section including a thickened base extending from the sole 6 as shown in FIG. 2.

The faceplate 8 is a laminated molding of a plurality of sheets of long carbon fiber impregnated with thermoplastic resin. The faceplate 8 is formed into a predetermined shape by heat-hardening the sheets packed in the recess 7. The recess 7 may preferably be formed so that its width may become gradually smaller towards the front opening to prevent the faceplate 8 from coming off the recess 7 after hardening of the fiber reinforced resin.

The faceplate 8 is assembled with the head 1 with no surface step between the lower marginal edge of the former and the front end face or leading edge of the sole 6 of the latter. Further, the front face of the faceplate 8 has cut therein several lateral grooves for imparting spin to a golf ball.

Figure 4:
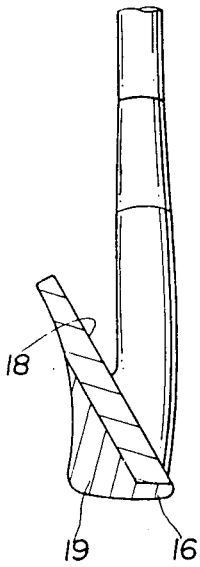
FIG. 4 is a sectional view of the golf club head in FIG. 3.
Figure 3:
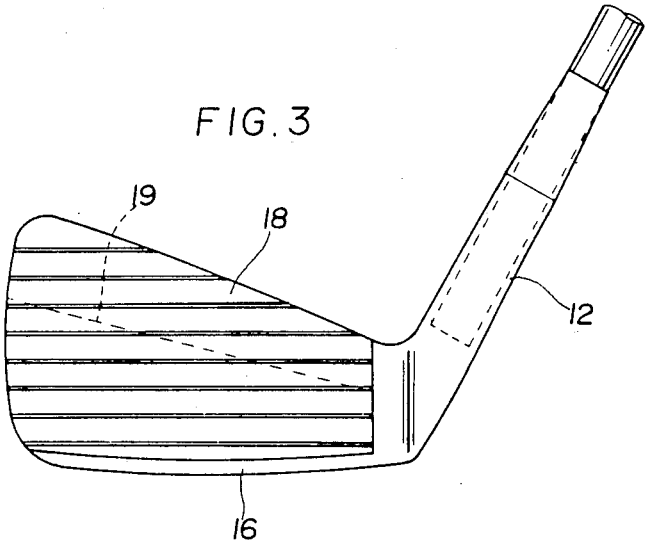
FIG. 3 is a front view illustrating a second embodiment of the golf club head of the present invention.

FIGS. 3 and 4 illustrate a second embodiment of the club head structure of the present invention. In this embodiment, a hosel 12, a sole 16 and a core 19 which projects in a triangular section from the sole 16 are formed as a unitary structure as in the first embodiment. The core 19 is formed thinner and smaller than those of traditional iron club heads and a faceplate 18 made of carbon fiber reinforced resin similar to that used in the first embodiment is secured firmly to the front face of the core 19 integrally therewith. Since this embodiment is identical in construction with the first embodiment except in the above said points, no further detailed description will be given.

In either embodiment, the faceplate for hitting a ball is formed by the carbon fiber reinforced resin, and hence has a larger repulsive force and higher elasticity than those obtainable with the conventional iron clubs, thereby increasing distance of the ball. Further, the faceplate is less hard than conventional ones and, when hitting the ball, it is somewhat compressed and bent, so that its contact area and time with the ball will increase, thus directing the ball in a stable direction. Moreover, the backing of the faceplate with the core allows thinning of the faceplate as required and prevents twisting of the faceplate between the toe and the heel of the club head when hitting the ball. Besides, the sole of the club head is made of metal as is the case with conventional iron clubs, and hence is not likely to be damaged by pebbles, sand or the like, for example, when hitting a shot from bare ground, while providing a soft feeling to a golfer who hits the ball at the faceplate.

Figure 5:
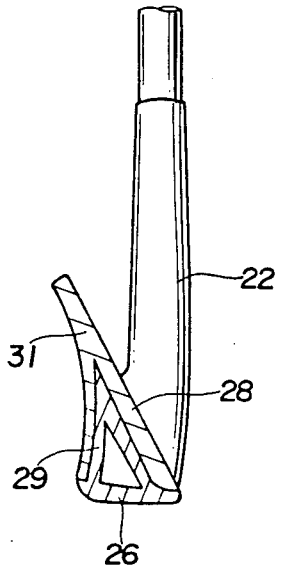
FIG. 5 is a sectional view illustrating a third embodiment of the golf club head of the present invention.

FIG. 5 illustrates, partly in section, a third embodiment of the golf club head of the present invention. Unlike the second embodiment, a core portion 29 which is hollow and triangular in cross section extends upwardly from a sole 26, and an outer head member 31 formed of carbon fiber reinforced resin, which is substantially the shape of an inverted letter V in cross section, is mounted on the core portion 29 as a unitary structure therewith to form a faceplate 28. The lower marginal edge of the faceplate 28 is flush with the front end face of the sole 26 and the rear lower marginal edge of the outer head member 31 is also flush with the rear end face of the sole 26. Since the hollow core portion 29 provides a relatively large repulsive force, it is possible to obtain a suitable repulsive force for the club head by properly determining the repulsive force of the core portion 29 relative to that of the faceplate 28. At the same time, the hollow core portion 29 produces a comfortable sound and hence creates a good feeling when hitting the ball.

Figure 6:
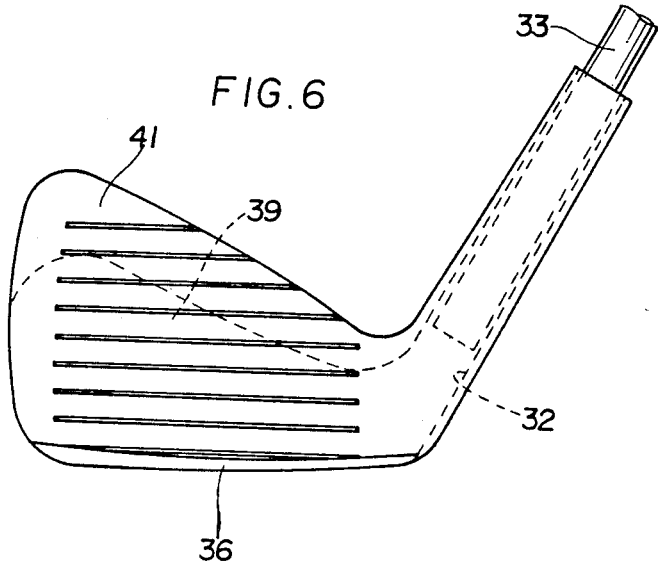
FIGS. 6 and 7 are front views illustrating fourth and fifth embodiments of the golf club head of the present invention respectively.

FIG. 6 illustrates a fourth embodiment of the head structure according to the present invention. The illustrated head structure is identical with that of the third embodiment in that its sole 36, core 39 and hosel 32 are formed as a unitary structure connected to a shaft 33 through the hosel 32. In this case, however, an outer head member 41 of carbon fiber reinforced resin includes a portion substantially in the shape of an inverted letter V mounted on the core portion 39 and another portion covers the entire area of the outer peripheral surface of the tubular hosel 32. Accordingly, in this embodiment, only the sole 36 is not covered with the carbon fiber reinforced resin layer 41. With such a head structure, since the hosel 32 on which the largest stress is imposed when hitting a ball is also covered with the carbon fiber reinforced resin layer, the hosel 32 is physically strengthened. This permits a reduction of the thickness of the metal core portion forming the hosel 32 to increase the flexibility between it and the head body for greater distance.

Figure 8:
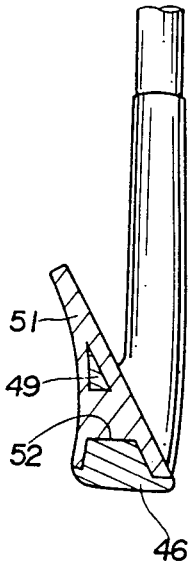
FIG. 8 is a sectional view taken on the line VIII—VIII in FIG. 7.
Figure 7:
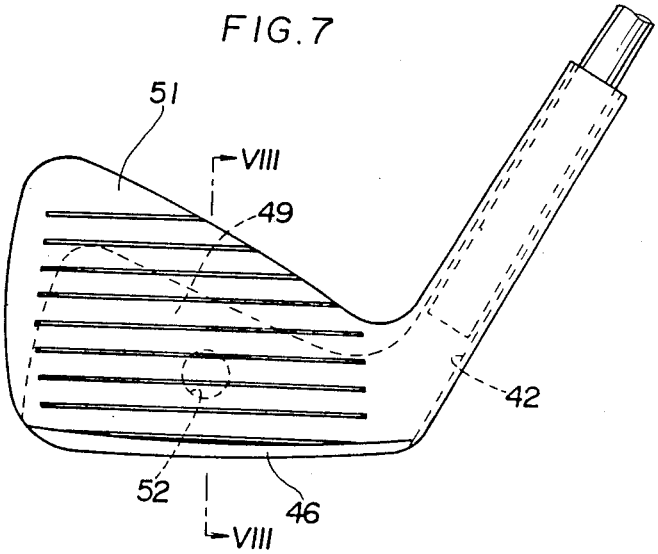

It will be appreciated that the core portion 39 in the fourth embodiment need not be limited specifically to the hollow structure. In the case of the core portion being not hollow but solid, it is preferred to make a through hole in the solid core portion as shown in FIGS. 7 and 8 which illustrate a fifth embodiment of the present invention. In this embodiment, a core portion 49 which is triangular in cross section and extends upwardly from a sole 46 has a through hole 52 formed substantially at the central portion thereof to extend therethrough perpendicularly to the plane of FIG. 7. An outer head member 51 of carbon reinforced resin is formed to cover the core portion 49 on both sides thereof in the shape of an inverted letter V. The through hole 52 is also filled with the carbon fiber reinforced resin to bridge the front and the back portions of the outer head member 51. Consequently, the outer head member 51 has a cross section substantially in the form of a letter A. With such a head structure, since the outer head member 51 is held firmly to the core 49 through the through hole 52, there is no possibility of the outer head member 51 coming or slipping off the core 49. Further, by making the through hole 52 in the core 49 at a position corresponding to a sweet spot of the clubface which is determined by various factors, the feeling when hitting a ball at the sweet spot and its distance and direction will be further improved.

Figure 9:
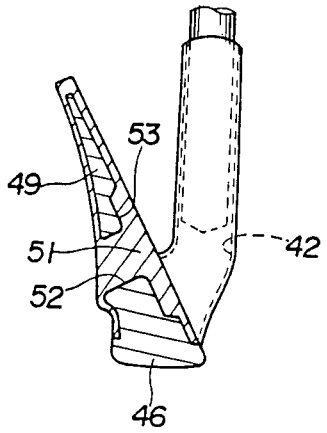
FIG. 9 is a sectional view showing a modified form of the club head of FIG. 8.

In the fifth embodiment, it is preferable to form a recess 53 of a relatively large area in the front of the core 49 centrally thereof and to make the through hole 52 in the bottom of the recess 53 as shown in FIG. 9. This permits an increase in the thickness of the carbon fiber reinforced resin layer 51 at the central portion of the clubface. Also, it is possible to obtain a club head of desired weight and balance by adjusting the area and depth of the recess 53.

Figure 10:
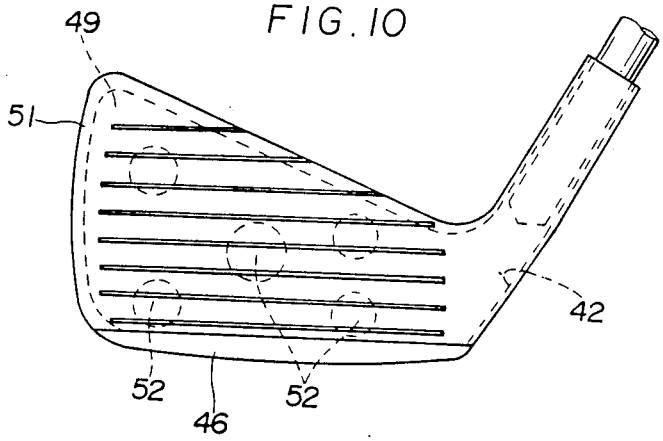
FIGS. 10 through 12 are front views showing modified forms of the club head of FIG. 7.
Figure 11:
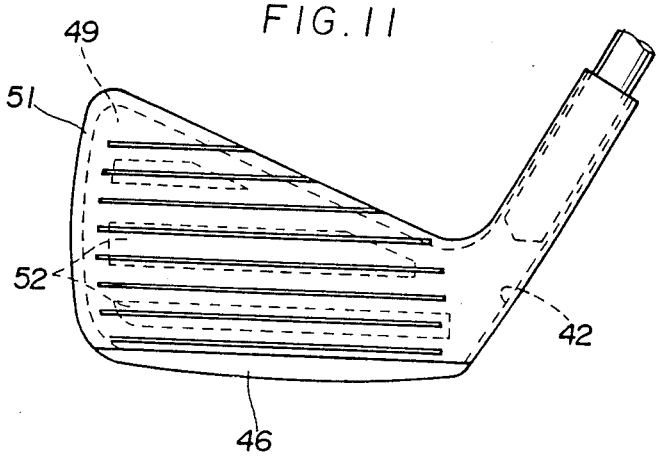
Figure 12:
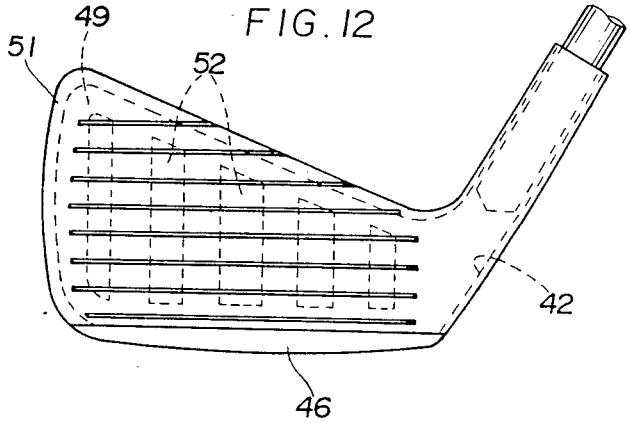

It is also possible to form a plurality of such through holes 52. FIG. 10 shows a club head in which a plurality of through holes 52 circular in cross section are formed as indicated by broken lines. The through holes 52 need not always be circular but may also be of other shapes, for example, slitlike. FIG. 11 shows an example in which a plurality of parallel through holes 52 are formed in the lateral direction and FIG. 12 an example in which parallel through holes 52 are formed in the vertical direction.

Figure 14:
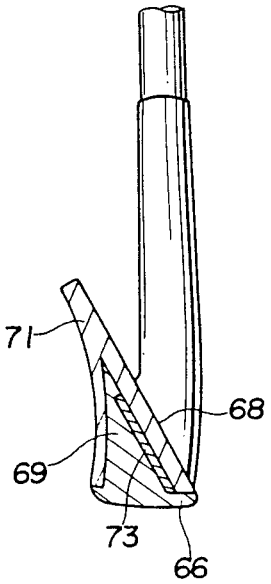
FIG. 14 is a sectional view of the golf club head in FIG. 13.
Figure 13:
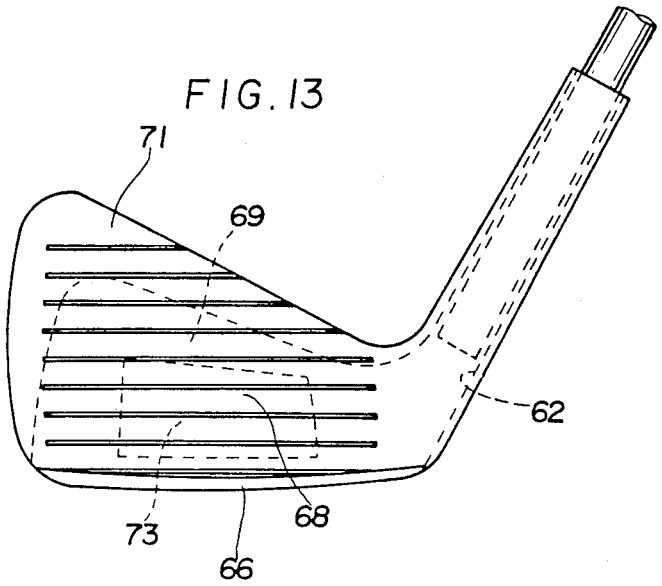
FIG. 13 is a front view illustrating a sixth embodiment of the golf club head of the present invention.

FIGS. 13 and 14 illustrate a sixth embodiment of the head structure of the present invention. The front of a core 69 formed integrally with a sole 66 to extend upwardly therefrom in a triangular cross section has a centrally disposed recess in which is packed a cushion material 73, such as foamed urethane, and the cushion material 73 is covered with an outer head member 71 of carbon fiber reinforced resin which is formed to cover the whole of the core 69. The cushion material 73 cooperates with the carbon fiber reinforced resin to provide clubface 68 with a large repulsive force. Accordingly, by disposing the cushion material in the central portion of the clubface about at the sweet spot thereof, the distance of the ball will be further increased.

In the club head structures of FIGS. 7 to 14, the hosel 42 or 62 is covered with the carbon fiber reinforced resin 51 or 71 as in the fourth embodiment. However, the characteristic structures of the fifth and sixth embodiments need not always be combined with that of the fourth embodiment.

Figure 16:
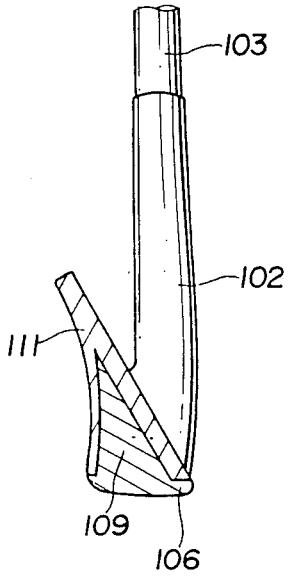
FIG. 16 is a sectional view of the club head in FIG. 15.
Figure 15:
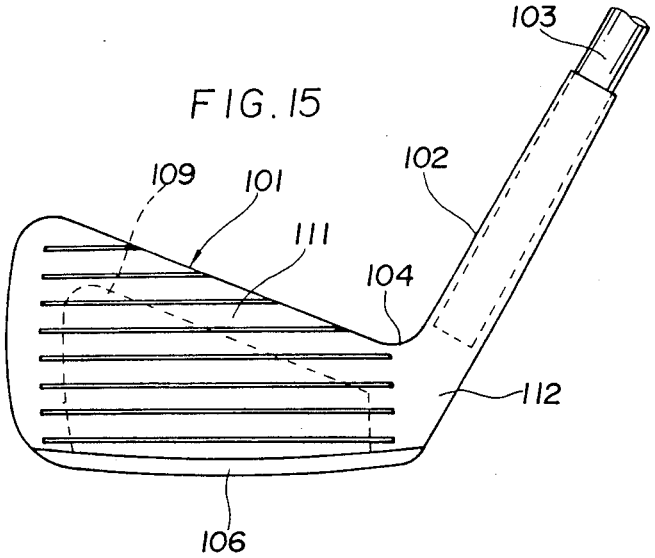
FIG. 15 is a front view illustrating a seventh embodiment of the golf club head of the present invention.

FIGS. 15 and 16 illustrate a seventh embodiment of the club head structure according to the present invention. This embodiment is identical with the foregoing embodiments in that a head portion 101 is formed by the lamination of several sheets of carbon fiber reinforced resin to cover a metal core 109 of a substantially triangular cross section and formed integrally with a sole 106. In this embodiment, however, the core 109 has no hosel for receiving a shaft 103. A carbon fiber reinforced layer 111 covering the core 109 is extended outwardly of the heel 104 of the head portion 101 and the extended portion is formed into a tubular hosel 102. Accordingly, the hosel 102 has no metallic core but is formed by the carbon fiber reinforced resin in its entirety. One of the advantages of this structure is that the weight of the head portion 101 can be increased without increasing the overall weight of the head, whereby the energy transmitted to the ball can be increased. This is based on the fact that the hosel 102 is formed of a material having excellent strength per weight. In addition, increased flexibility of the head structure between the head portion 101 and the hosel 102 is more apparent than in the case of the fourth embodiment.

Figure 18:
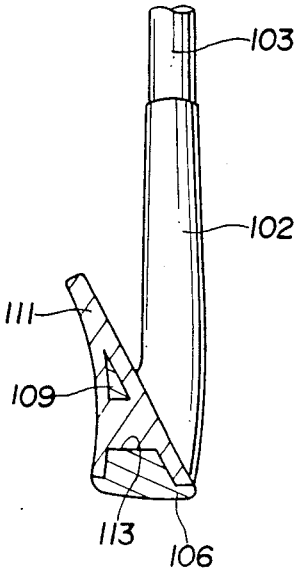
FIGS. 17 and 18 are front and sectional views, respectively, showing modified forms of the club head of the seventh embodiment.
Figure 17:
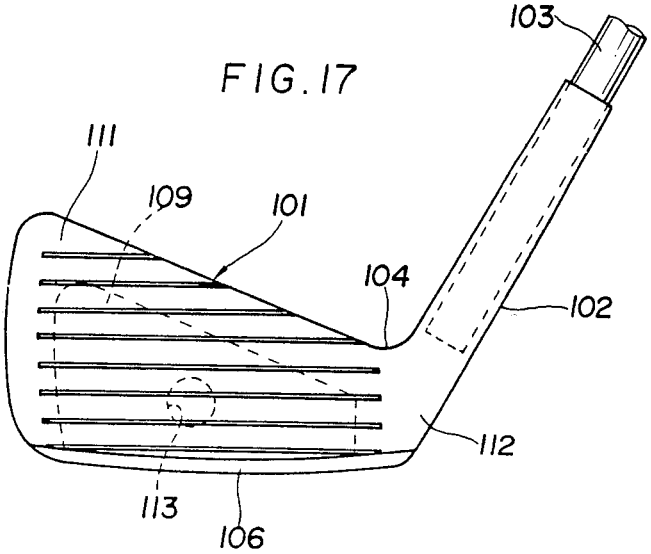
Figure 20:
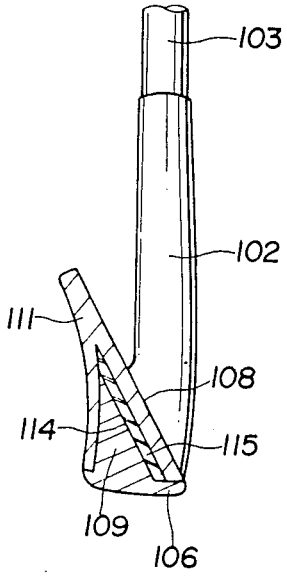
FIGS. 19 and 20 are front and sectional views, respectively, showing other modifications of the club head of the seventh embodiment.
Figure 19:
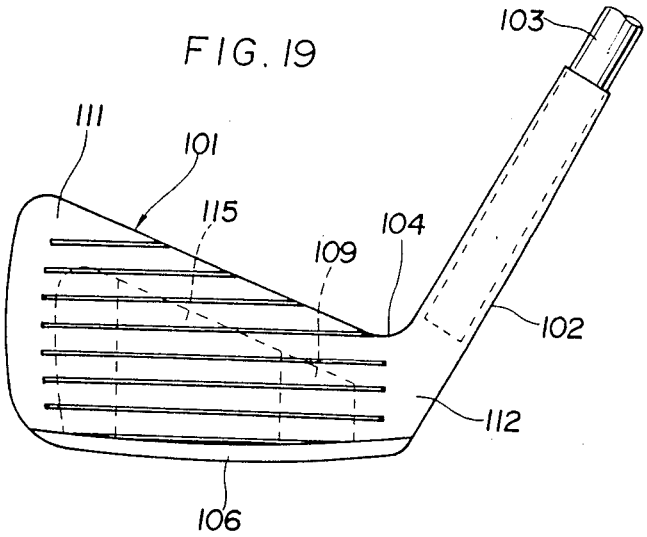

The core 109 of the seventh embodiment is substantially identical with those of the foregoing embodiments except that it has no hosel. Accordingly, the seventh embodiment also permits some modifications, two of which are shown in FIGS. 17 to 20. In FIGS. 17 and 18, a core 109 has a centrally disposed through hole 113, by which outer head member 111 of carbon reinforced resin and the core 109 are firmly coupled with each other as one body. In FIGS. 19 and 20, a cushion material 115 as of foamed urethane is packed into a recess 114 formed in the front of core 109 centrally thereof in order to give a larger repulsive force to the clubface 108.

While in the foregoing the present invention has been described in connection with preferred embodiments thereof, it will be seen that the embodiments permit various combinations. Further, the present invention is not limited specifically to the foregoing embodiments and may be possible of many modifications and variations within the scope of the present invention.

What is claimed is:

1. A golf club head comprising:

a sole formed of metal material;

a core of metal material formed integrally with said sole, said core extending upwardly from said sole and having a substantially triangular shape in cross section, a lower end of said core having a thickness in a direction of swing of the head smaller than that of said sole to provide front and rear shoulders therebetween;

an outer head member formed of carbon fiber reinforced resin material, said outer head member having a substantially inverted V-shaped cross-sectional configuration covering the entirety of said core, lower ends of said outer head member being in close contact with said shoulders with marginal edges of said lower ends being flush with said sole; and a hosel for receiving a shaft therein and formed of carbon fiber reinforced resin material, said hosel being integral with said outer head member at a heel portion of the golf club head.

2. A golf club head as claimed in claim 1, wherein said core is hollow.

3. A golf club head as claimed in claim 1, wherein a through hole is formed in said core to extend therethrough from the front to the back thereof, said through hole being filled with said carbon fiber reinforced resin material.

4. A golf club head as claimed in claim 3, wherein said through hole is substantially circular.

5. A golf club head as claimed in claim 3, wherein a recess of an area larger than said through hole is formed in the front of said core centrally thereof, and said through hole is formed to extend from the bottom of said recess.

6. A golf club head as claimed in claim 1, wherein a plurality of parallel slits are formed in said core to extend therethrough from the front to the back thereof, said slits being filled with said carbon fiber reinforced resin material.

7. A golf club head as claimed in claim 1, wherein a recess is formed in the front of said core centrally thereof, and further comprising a layer of a cushion material fitted in said recess between said core and said outer head member.

* * * * *